United States Patent [19]

Ting

[11] 4,206,724

[45] Jun. 10, 1980

[54] AUTOMOBILE FUEL INJECTION CONTROL DEVICE

[76] Inventor: Hui-tzeng Ting, c/o M. Rosenblatt & Son, Inc., 350 Broadway, New York, N.Y. 10013

[21] Appl. No.: 916,888

[22] Filed: Jun. 19, 1978

[51] Int. Cl.[2] ..... F02M 51/02
[52] U.S. Cl. ..... 123/32 AE
[58] Field of Search ..... 123/32 AE, 32 EA, 127

[56] References Cited

U.S. PATENT DOCUMENTS

| | | | |
|---|---|---|---|
| 2,863,437 | 12/1958 | Bessiere | 123/32 AE |
| 4,127,087 | 11/1978 | Caves | 123/32 AE |
| 4,147,137 | 4/1979 | Firey | 123/127 X |

FOREIGN PATENT DOCUMENTS

| | | | |
|---|---|---|---|
| 552052 | 1/1958 | Canada | 123/32 AE |
| 841202 | 7/1960 | United Kingdom | 123/32 AE |

*Primary Examiner*—Tony M. Argenbright

[57] ABSTRACT

Multiple signal bits are used to create basic fuel injection time intervals which are combined to produce many different injection time intervals of which the consecutive time difference becomes negligibly small such that practically smooth and stepless control of fuel injection becomes feasible with a simple device. The device enables its relative engine to run under either stratified fuel distribution mode for antipollution purpose or anti-stratified fuel distribution mode for acceleration purpose. The device can also be used on existing fuel injection engines with resulting elimination of the main injector and the intake manifold and improvement in volumetric efficiency and engine performance.

9 Claims, 4 Drawing Figures

AUTOMOBILE FUEL INJECTION CONTROL DEVICE

This invention covers an automobile fuel injection device applicable to existing fuel injection gasoline engines and the new engine of my invention (Ser. No. 867,480, filed Jan. 6, 1978) in which the following principle is applied.

It is stated on page 703 of H. Schlichting, *Boundary-Layer Theory,* 6th Edition, McGraw-Hill, 1968, that "the process of turbulent mixing causes a transfer of the properties of the fluid (such as floating droplets of gasoline) in a direction at right angles to the main stream."

Thus, in the case of internal combustion engines with fuel injection, if the fuel is injected onto the stem side of the intake valve when the valve is closed, the fuel-rich parcel of air-fuel mixture created there will enter the cylinder and spread on top of the piston and the air-rich parcel following it will not mix very well with it. Therefore, at the end of the intake stroke, a stratified condition of the fuel distribution is formed.

Each cylinder of the said new engine has a new cylinder head which has a recess called the lean mixture chamber, and which has an additional rich mixture chamber coming into shape when the piston reaches its top dead center, such that the aforesaid air-rich (i.e., lean mixture) and fuel-rich (i.e., rich mixture) parcels can remain segregated until ignition takes place.

In order to make the new engine work, the new fuel injection control device is needed which is different from the injection control devices of existing engines which receive a spray of fuel onto the stem side of every intake valve at the same instant regardless of the piston position or valve events, and which are equipped with a main injector located in the intake manifold to supply all the cylinders with extra amounts of fuel when it is needed. My invention of the new device comes out of necessity of my invention of the said anti-pollution engine which requires specific injection timing with respect to the piston position or valve events. However, the new device can also be applied to the existing fuel injection engines with the benefit of eliminating the said main injector and the intake manifold which causes a reduction in volumetric efficiency. In addition, the time available for gasoline to mix with air to form a rich mixture parcel before it enters the cylinder, can be as long as three piston strokes, and the time available for the rich mixture parcel to stay in the cylinder before it is ignited is about two piston strokes. Thus the essential requirements of complete combustion with respect to mixing, air, temperature and time are fulfilled by this engine to a high degree. For this basic concept, one may refer to page 362 of "General Principles of Combustion," Chapter XXVIII, pp. 360–402, *Elements of Heat Power Engineering,* Part II, by W. N. Barnard, F. O. Ellenwood, and C. F. Hirshfield, Wiley, 1933.

The embodiment of the invention is illustrated by the drawings of FIGS. 1, 1A, 1B, and 2.

DETAILED DESCRIPTION OF THE DRAWINGS

Figure 1A:
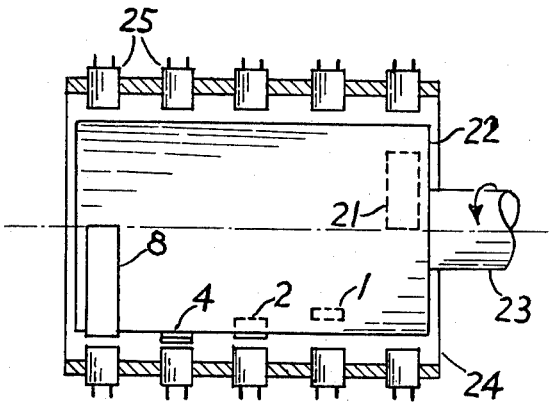
Figure 1:
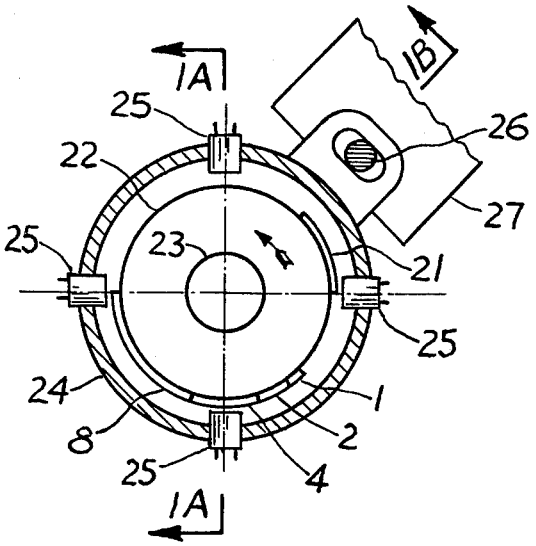
Figure 1B:
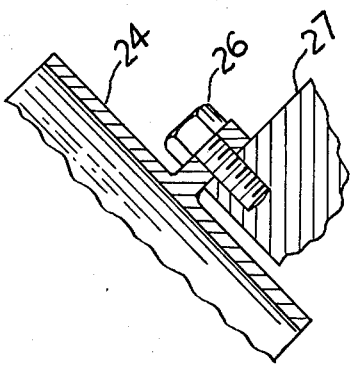

FIG. 1 shows the side view of the ICD assembly which is designed for a four-stroke four-cylinder engine. The ICD 22 is carried by its shaft 23 which synchronizes with the cam shaft of the engine. A fixed arm or bracket 24 holds four sets of sensors 25, and is affixed to the engine frame 27 by the bolt 26 at which the bolt hole is elongated for adjusting the position of the arm with respect to the engine frame. A partial section through the bolt is shown in FIG. 1B.

FIG. 1A shows the sectional elevation of the ICD assembly. The drum surface is conditioned with five signal bits, namely one HLB 21, and four NLB's 1,2,4 and 8. Each bit is scanned by one sensor 25. When a bit and its sensor meet each other, an electrical impulse is produced to cause fuel injection at the relative fuel injector located at the stem side of the relative intake valve of the engine. The sensor can be a carbon or metal brush, a photo-electric cell, or a magnetic coil to suit the design of its relative signal bit.

Figure 2:
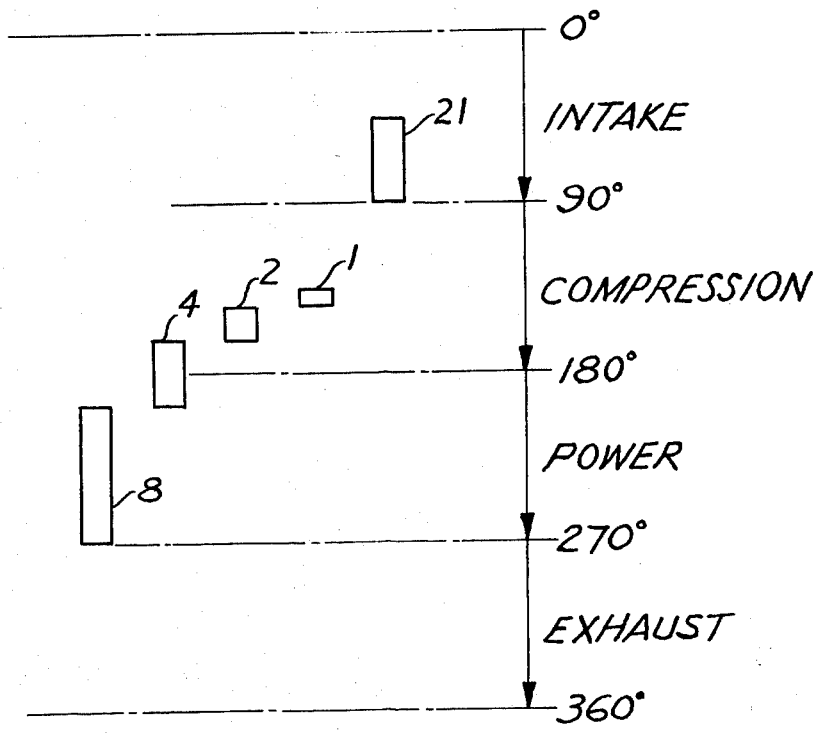

FIG. 2 shows the developed view of the signal bits which lies on circular tracks. In order to simplify the illustration, each stroke of the engine is assumed to be exactly 180 degrees of crankshaft angle or 90 degrees of camshaft angle. In this simple design, the lengths of bits and their locations are given as follows. The position at which the intake valves starts to open, is defined as zero degree.

| Identity No. of Bit | Position of Leading Edge | Position of Ending Edge | Length of Span |
|---|---|---|---|
| | (Unit in Degrees of Camshaft Angle) | | |
| 21 | 45 | 90 | 45 |
| 1 | 135 | 144 | 9 |
| 2 | 144 | 162 | 18 |
| 4 | 162 | 198 | 36 |
| 8 | 198 | 270 | 72 |

Let us define the length of bit 1 as one length unit (LU). Thus the lengths of bits 1,2,4 and 8 are 1,2,4 and 8 LU respectively. If the electrical signals are combined into different serial circuits, the combined available lengths will be 1,2,3 (=1+2), 4,5 (=1+4), 6 (=2+4), 7 (=1+2+4) and so on to 15. Such fifteen steps of choices can be electrically wired onto a drum type switch attached to the gas pedal. The resulting control will be practically stepless because each step is so small.

Let the fuel injector be a simple constant pressure type such as Bosch gasoline injector. Thus the engine speed and the said injection timing steps must match each other with the highest step or 15 LU to be used at highest engine speed such that the air-fuel ratio of the mixture to be ready for ignition inside the said rich mixture chamber will not be beyond the acceptable range of spark ignition.

When a large or sudden acceleration is needed, the jerk on the gas pedal can be sensed by a dash pot and a pressure switch, or an additional push button can be pressed by the automobile driver, such that the sensor of the HLB 21 is in series electrically with the sensors of the NLB's. In this case, fuel injection also takes place when the intake valve is open, and the said air-rich parcel becomes fuel-rich. At the end of the intake stroke, the whole cylinder is distributed with fuel. The engine is running under anti-stratified fuel distribution mode, so to speak.

The aforesaid fuel injection control device is digital. It is obvious that the temperatures of air and engine wall, the engine speed, and other parameters impacting the amount of fuel to be injected, can be transformed by simple instruments into few digital steps, and be incorporated into a more advanced injection control system which will be a logical consequence of digital computer programming.

I claim:

1. A method of controlling the distribution of fuel inside each cylinder of a spark-ignition internal combustion engine at the end of the intake stroke so as to accomplish the required fuel distribution either when the engine is running under stratified fuel distribution mode at normal load for anti-pollution purpose, or when the engine is running under anti-stratified fuel distribution mode for acceleration purpose, by (1) locating one electrically operated fuel injector at the stem side of each intake valve of the engine;

(2) providing an injection control drum or disc (ICD) driven synchronously with the cam shaft of the engine;

(3) conditioning the surface of the said ICD with multiple circular tracks of signal bits comprising one heavy load bit (HLB) and multiple normal load bits (NLB);

(4) providing one set of sensors for each fuel injector to pick up each signal from each said signal bit on the ICD. Each set of sensors being fixed on one arm affixed to the engine frame with its position adjustable with respect to the engine frame;

(5) locating the HLB on one track of the ICD such that when the HLB and its relative sensor meet each other, the intake valve of the cylinder of the relative fuel injector is open and fuel injection takes place due to the electrical impulse from the sensor;

(6) locating each of the NLB's on each individual track in consecutive order of time such that only one pair comprising one NLB and its relative sensor, can meet each other at one instant, and such that when the pair do meet, the intake valve of the cylinder of the relative fuel injector is closed and fuel injection takes place due to the electrical impulse from the sensor; and (7) combining electrically the signals from the HLB and NLB's into different serial circuits, each of which controls the duration of fuel injection and the fuel distribution inside each cylinder at the end of the intake stroke such that a stratified fuel distribution mode can be obtained by the combination of different electrical impulses from different NLB's, and an anti-stratified fuel distribution mode can be obtained by the combination of electrical impulses from the HLB and one or more NLB's.

2. The method of claim 1 wherein said conditioning step limits the maximum length of said HLB to one-fourth ($\frac{1}{4}$) of the circular track on said ICD for a four-stroke engine.

3. The method of claim 1 wherein said conditioning step limits the maximum total length of the NLB's to three fourths ($\frac{3}{4}$) of the circular track on said ICD for a four stroke engine.

4. The method of claim 1 or 3 wherein said conditioning step provides that the total length of the NLB's is distributed to the proportion defined by the series of 1, 2, 4, 8, etc., such that combined lengths will be 1, 2, 3, (bits 1 and 2), 4, 5 (bits 1 and 4), 6 (bits 2 and 4), 7 (bits 1, 2, and 4), etc.

5. The method of claim 1 further including the step of constructing the sensors as electric carbon brushes.

6. The method of claim 1 further including the step of constructing the sensors as photoelectric cells.

7. The method of claim 1 further including the step of constructing the sensors as magnetic coils.

8. The method of claim 1 further including the step of constructing the sensors as metal brushes.

9. The method of claim 1 wherein said conditioning step provides more than one HLB to be located on different tracks of the ICD, each HLB having its own signal sensor.

* * * * *